US006892954B2

(12) United States Patent
Srinivasan

(10) Patent No.: US 6,892,954 B2
(45) Date of Patent: May 17, 2005

(54) METHOD FOR CONTROLLING A SPRAY PROCESS

(75) Inventor: Vasudevan Srinivasan, Winter Springs, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/454,806

(22) Filed: Jun. 4, 2003

(65) Prior Publication Data

US 2004/0245354 A1 Dec. 9, 2004

(51) Int. Cl.[7] ..... B67D 5/38
(52) U.S. Cl. ..... 239/74; 427/446
(58) Field of Search ..... 239/73, 74; 427/446; 219/121.42

(56) References Cited

U.S. PATENT DOCUMENTS

| | | | | |
|---|---|---|---|---|
| 5,138,157 | A | 8/1992 | Jones et al. | 250/251 |
| 5,249,136 | A | 9/1993 | Kumagai | 358/139 |
| 5,302,414 | A | 4/1994 | Alkhimov et al. | 429/192 |
| 6,263,300 | B1 | 7/2001 | Strumolo et al. | 703/8 |
| 6,438,239 | B1 * | 8/2002 | Kuchen | 381/171.1 |
| 2004/0031776 | A1 * | 2/2004 | Gevelber et al. | 219/121.36 |

OTHER PUBLICATIONS

Koch, D., et al Diagnostic of in flight particle properties and resulting coating qualities on atmospheric plasma spray process. Thermal Spray 2001: New Surfaces for a New Millennium, (Ed.) C.C. Berndt, et al. Metals Park, OH: ASM International, 2001, pp. 751–758.

* cited by examiner

*Primary Examiner*—Harry B. Tanner

(57) ABSTRACT

A method is provided for controlling a spray process that may include measuring a particle property associated with a spray jet of particles, calculating a centroid for the measured particle property and using the calculated centroid as a control parameter for controlling the spray process. At least one operating parameter associated with the spray process may be adjusted in response to the calculated centroid to change a trajectory of at least a portion of the particles within the spray jet of particles. The operating parameter may be adjusted so that an ensemble of particles having the highest measured temperature and an ensemble of particles having the highest measured velocity and an ensemble of particles having the highest measured flow rate are moved more closely together to create a common region proximate a surface of a substrate to be coated by the spray process. This may be done manually prior to a coating run or continuously during a run using a closed-loop feedback circuit (43) in a computer-controlled (38) spray system.

13 Claims, 3 Drawing Sheets

METHOD FOR CONTROLLING A SPRAY PROCESS

FIELD OF THE INVENTION

The present invention relates in general to methods for depositing particles on a substrate and, more particularly, to a method for monitoring and controlling a spray process in terms of the properties and flow rates of in-flight particles during the deposition of the particles on a substrate.

BACKGROUND OF THE INVENTION

The deposition of particles on articles or substrates may employ various processes including hot spray processes that use combustion or plasma as the heat source. The hot spray of materials or particles on substrates, such as components in a gas turbine for example, may produce multiple surface layers on the substrate having properties that may gradually change and complement the properties of the substrate. The deposited surface layer is intended to protect the substrate during its service against aggressive and hostile environmental attack and extend the component's service life and performance.

Known methods of hot spraying materials may use a continuous heat source to partially and/or fully melt the aggregate of material to be deposited. The aggregate of material may be in a suitable form of feedstock such as non-agglomerated powder, cast rod, wrought or pellet-encapsulated wire or a solution with chemical pre-cursors that is continuously delivered into the heat source. The form of feedstock for metallic and/or non-metallic materials may include powders of uniform size, powders with a known size distribution and/or powders encapsulated in fine tubes such as the commercially available Sultzer-Metco nickel-aluminum AMDRY 404NS feedstock.

Spray torches or guns known in the art may use combustion and plasma gases as heat sources for hot spray. The heat source may be enclosed in a compact container with inlets and outlets for the reactants used for combustion or the plasma gases used for plasma generation and for cooling fluid. The container may also include a nozzle for spraying and a method of introducing the depositing materials into the combustion products or plasma beam. Combustion based hot spray processes, or thermal spray processes, may be performed at atmospheric air pressure. When an oxy-fuel is used in the combustion process, the spray process is called High Velocity Oxy-Fuel (HVOF) process. Low-pressure plasma spray ("LPPS") or vacuum plasma spray ("VPS") processes are known as well as an air plasma spray ("APS") process. In thermal spray and plasma spray processes using powder feedstock, the depositing material may be introduced into a hot plume either concentrically or downstream at an angle to the plume axis by using a carrier gas. The high velocity combustion or plasma gases propel particles entrained within a spray beam or jet onto the surface of the substrate to be coated. These particles may consist of fully and/or partially molten particles, as well as un-melted hot particles. Individual particles within the spray jet may have a range of properties such as temperature, velocity and diameter. Commercially available in-flight particle analyzers, such as the DPV 2000 manufactured by TECNAR, allow for quantitatively measuring these and other in-flight particle properties.

Known suppliers of equipment used for hot spraying may provide ranges for each operating parameter of the equipment and projections regarding a resultant coating's quality and structure. This may be done by trial and error, design of experiments or other iterative approaches by using a flat plate as a target to arrive at such ranges of operating parametric values that are provided to the end user of the spray equipment. For example, an operator may select a set of operating parameters and spray a test coating on a substrate. A metallurgical analysis of the test coating may then be performed to determine whether the coating is within specified coating quality and structure limits. If the test coating is not within these limits then the operator may repeat the process not only changing the gun and powder feed operating parameters within recommended ranges, but also varying the spray gun speed, its spray or "standoff" distance from the plate and lateral stepwise displacement, for example, until the test coating specifications are acceptable.

Once the operating parameters are optimized for a specified coating, it is expected to reproduce the specified coating quality and structure on subsequent coating runs, article-to-article and batch-to-batch. However, reproducing the specified coating on subsequent coating runs often proves to be difficult even though the same optimized operating parameters are used on restart of the hot spray system. This may be due to the non-reproducibility of the expected in-flight particle properties on restart. This may result in a wide variation in coating quality and structure from one location to another on a coated substrate, from one coated substrate to another and from batch-to-batch of coated substrates. These results may cause the rejection of non-conforming substrates, stripping the non-conforming coating and re-coating, or relaxing the coating specifications to reduce the rejection rate. Each of these results increases the cost of production and/or compromises the performance of the coated article.

SUMMARY OF THE INVENTION

Aspects of the present invention are based on the determination that the geometrical or spatial relationship between the particle properties of temperature, speed (velocity) and spatial flow rate in a thermal or plasma spray jet, for example, is an important factor affecting the quality and structure of an applied coating. It has been determined by the inventor of the present invention that using these measured in-flight particle properties as a parameter for controlling a spray process allows for producing high quality coatings that may be consistently reproduced.

One aspect of the present invention provides criteria in an analytical form to control the in-flight properties of ensembles or groups of particles during a hot spray deposition by adjusting the operating parameters of the system. An ensemble of particles may be defined as a group of individual particles within a cross sectional area of a spray jet. For example, the spray gun input parameters and/or feedstock injection parameters of the system may be adjusted to control the in-flight particle properties. This may be done manually prior to a coating run or continuously during a run using a closed-loop feedback circuit in a computer-controlled hot spray system. Another aspect of the present invention allows for using these criteria to reproduce coatings with specified quality and structure on restart of a hot spray system.

A method is provided for controlling a spray process that may include measuring a particle property associated with a spray jet of particles, calculating a centroid for the measured particle property and using the calculated centroid as a control parameter for controlling the spray process. One aspect allows for adjusting at least one operating parameter associated with the spray process in response to the calculated centroid to change a trajectory of at least a portion of the particles within the spray jet of particles. The operating parameter may be adjusted so that an ensemble of particles having the highest measured temperature and an ensemble of particles having the highest measured velocity and an ensemble of particles having the highest measured flow rate are moved more closely together or are substantially coincident proximate a surface of a substrate to be coated by the spray process.

Another exemplary method is provided that may include measuring a plurality of particle properties associated with a spray jet of particles, calculating a centroid for each measured property and using the calculated centroids as a control parameter for controlling the spray process. At least one operating parameter of the spray process may be adjusted in response to the calculated centroids so that the spray process produces a spray jet within which an ensemble of particles having the highest temperature and an ensemble of particles having the highest velocity and an ensemble of particles having the highest flow rate define respective trajectories that form a common region proximate a surface of a substrate to be coated.

Another exemplary method is provided for controlling a hot spray process that uses a continuous heat source for partially and/or fully melting particles, a feedstock of particles to be propelled within a spray jet, a continuous delivery system for delivering particles from the feedstock into the heat source to form a spray jet of particles and may include determining whether an ensemble of particles having the highest temperature and an ensemble of particles having the highest velocity and an ensemble of particles having the highest flow rate form a common region within the spray jet. At least one operating parameter of the hot spray process may be adjusted in the event the respective ensembles of particles are not within the common region.

BRIEF DESCRIPTION OF THE DRAWINGS

These and other advantages of the invention will be more apparent from the following description in view of the drawings that show.

DETAILED DESCRIPTION OF THE INVENTION

The hot spray deposition of materials builds up on a substrate as partially and/or fully molten hot particles impact and adhere onto a surface of the substrate. Un-melted hot particles may also adhere to molten material existing on the surface of the substrate. Particles may impact and deform on the surface to become a building block for deposition evolution. The deposition will build up faster in areas of impact having the highest particle flow rate. This is where the largest numbers of such particles per unit area impact the substrate's surface, assuming each particle has the same sticking coefficient or probability.

Figure 1:
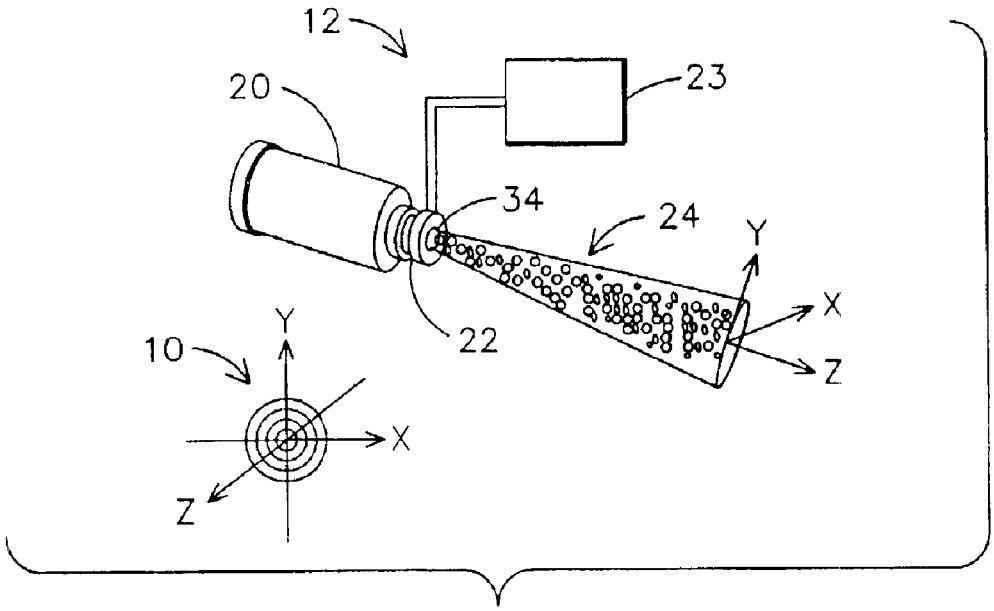
FIG. 1 PRIOR ART
FIG. 1 is a schematic of an exemplary hot spray system that may be used in accordance with aspects of the present invention.

In a hot spray system where a powder feedstock is concentrically introduced into an axis-symmetric plasma or combustion gas jet, the iso-property contours of the particles should form concentric circles 10, as shown in FIG. 1, to produce a coating of high quality and structure. In this respect, the region within the gas jet containing particles of maximum particle flow rate will also contain particles of maximum particle temperature and velocity. This region may be defined in terms of a cross sectional area of a spray jet and may be proximate a surface of a substrate to be coated. The maximum values of particle temperature, velocity and flow rate will be realized at the center of the concentric circles 10 and will decrease radially outwardly. FIG. 1 also illustrates schematically an exemplary hot spray system 12 that may include a hot spray gun 20, such as a commercially available METCO F4 air plasma gun, having a powder port 22. The powder port 22 may introduce the feedstock powder from feedstock container 23 into a plasma jet at an angle to the spray jet so that a continuous plasma jet 24 is formed for propelling the powder toward a substrate. Other exemplary spray systems may introduce feedstock concentrically or co-axially into the plasma jet spray using one or more input ports.

Figure 2:
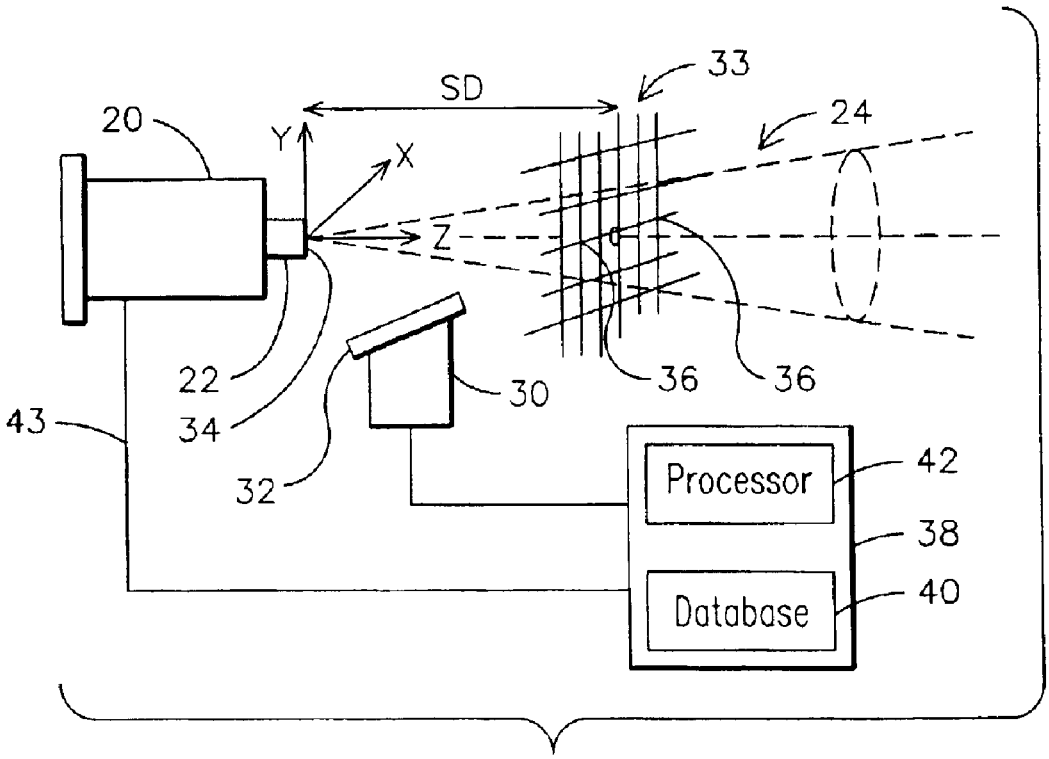
FIG. 2 is a schematic plan view of the hot spray system of FIG. 1 and an exemplary particle analyzer that may be used with aspects of the present invention.

FIG. 2 illustrates a schematic plan view of a spray gun 20 and an in-flight particle analyzer 30 having a sensor head 32. The analyzer 30 may be a commercially available analyzer such as the DPV 2000 manufactured by TECNAR. The DPV 2000 sensor head 32 may be positioned perpendicular to the Z-axis at a distance that may be determined by the optical system of the sensor head. One aspect of the present invention allows for the cross section or grid 33 of the spray jet 24 for measuring in-flight particle properties to be at a distance from the spray gun nozzle 34 approximately equal to the standoff distance ("SD") used for spraying substrates or components. In this respect, the in-flight particle property measurements will be taken in a plane that corresponds to a surface of the substrate to be coated during a coating run. In one exemplary embodiment the stand off distance may be about 10 inches.

The optical sensor head 32 is capable of X- and Y- travels and may be programmed to move in various steps such as in steps of 3 or 5 mm forming a grid or lattice of 7 by 7 or 9 by 9. The number of grid or lattice points and the step change of the sensor head 32 may be denoted as 49_3; 49_5, 81_5, for example. The analyzer 30 may be programmed to take measurements and collect data at each of a plurality of lattice points 36 as will be recognized by those skilled in the art. The sensor head 32 may measure and collect data indicative of the temperature and velocity of each in-flight particle that passes through each lattice point 36 and the total particle flow rate through each lattice point 36. Data indicative of the average or mean numerical values of the temperature and velocity, and total particle flow rate for each lattice point 36 may be transferred to a conventional computer such as computer 38 and stored in a conventional computer memory such as database 40. A conventional data processing module such as processor 42 may be provided for controlling the analyzer 30, managing data transfer and performing associated calculations in accordance with aspects of the present invention.

The sensor head 32 may be preset for data collection at each lattice point 36 either for a fixed time or a fixed number of particles passing through the point, for example, whichever occurs first. In accordance with empirical testing conducted by the inventor of the present invention, Table 1 illustrates the maximum, mean and weighted average of temperature and velocity for three separate starts or ignitions of a hot spray system, such as hot spray system 12. Each start used the same operating parameters or settings for the spray gun 20 and feedstock injection. The weighted averages of speed (velocity) and temperature are estimated by:

$$\text{The weighted average of in-flight particle speed (velocity)} = \bar{S} = \frac{\sum_{i=1}^{n} S_i F_i}{\sum_{i=1}^{n} F_i}$$

and $$\text{The weighted average of in-flight particle temperature} = \bar{T} = \frac{\sum_{i=1}^{n} T_i F_i}{\sum_{i=1}^{n} F_i}$$

Where $S_i$, $T_i$ and $F_i$ are respectively the mean speed and temperature and the total flow rate of particles measured at the "$i^{th}$" lattice point 36, and "n" is the total number of lattice points 36. These weighted averages take particle flow rate into account and provide a statistical estimation of the particle properties of temperature and speed across the majority of the cross section or core of the spray jet 24. The core of the spray jet 24 may exclude those areas of disturbances or vortices of the spray jet 24.

As indicated in Table 1, for a selected measurement grid, such as grid 33, the numerical values for the maximum, mean and weighted average of particle temperature and speed from start-to-start of the three runs fall within fairly narrow ranges. This indicates that particle temperature and speed may be reproduced from start-to-start of a hot spray system within boundaries or ranges that would be expected to reproduce a coating having specified quality and structure. Table 1 also indicates that the maximum temperature for each run was higher than the mean and weighted average in a reproducible manner.

TABLE 1

APS with METCO F4 Gun

| | | Maximum | | Mean | | Weighted Average | |
|---|---|---|---|---|---|---|---|
| Run# | Grid | T° C. | Speed, m/sec. | T° C. | Speed, m/sec. | T° C. | Speed, m/sec. |
| 01:1/18/01 | 49_3 | 2709 | 227 | 2529 | 178 | 2554 | 186 |
| 01:2/27/01 | 49_3 | 2751 | 230 | 2526 | 186 | 2537 | 189 |
| 07:3/22/01 | 49_3 | 2772 | 223 | 2543 | 183 | 2553 | 185 |

Figure 3:
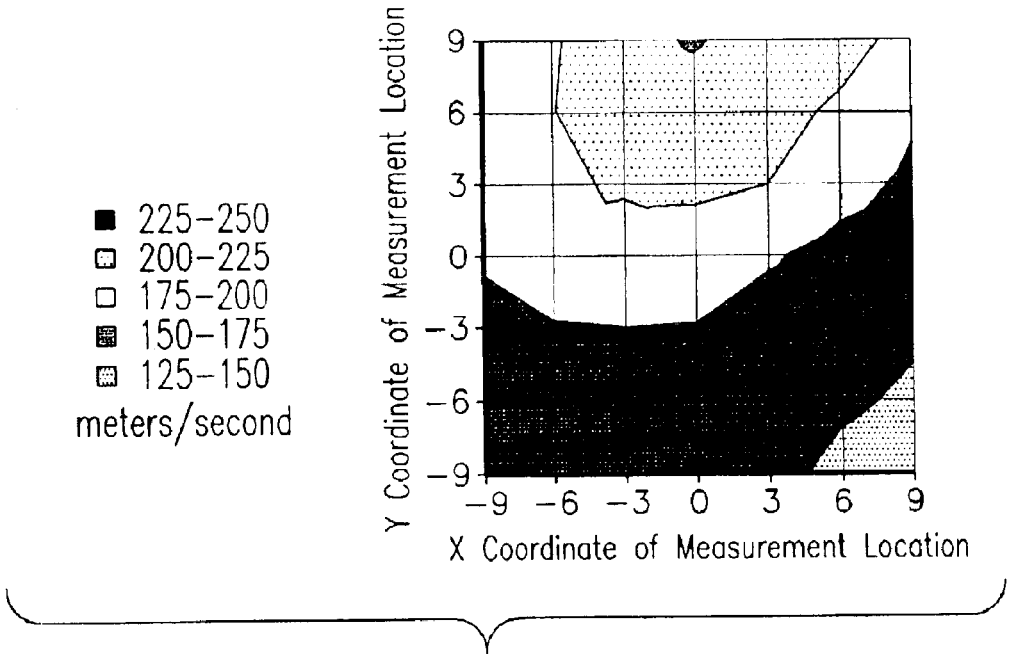
FIGS. 3, 4 and 5 illustrate exemplary measurements of particle properties.
Figure 4:
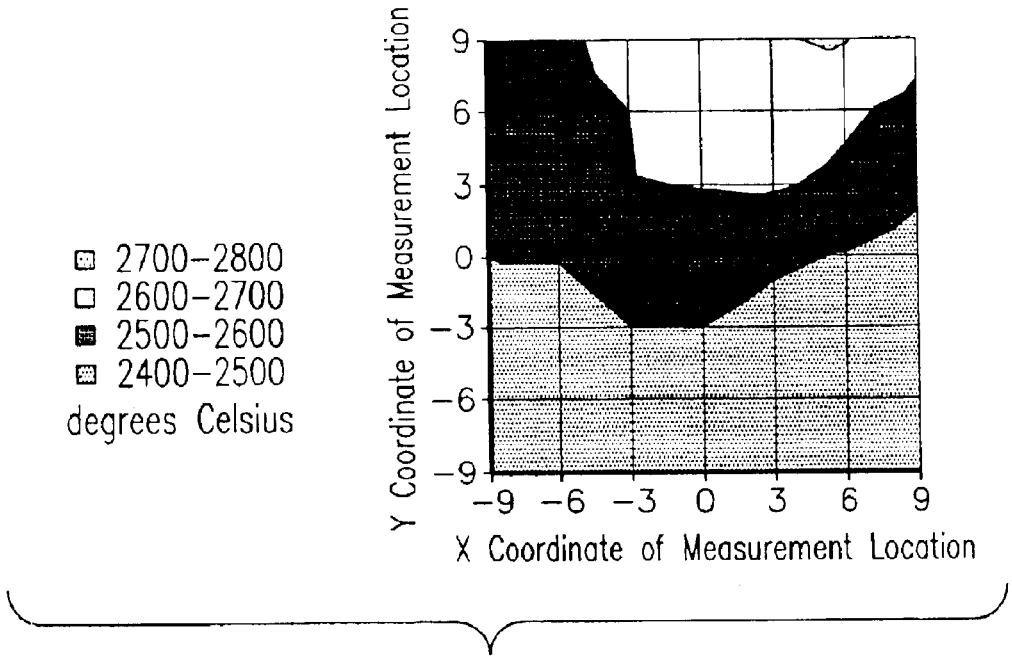
Figure 5:
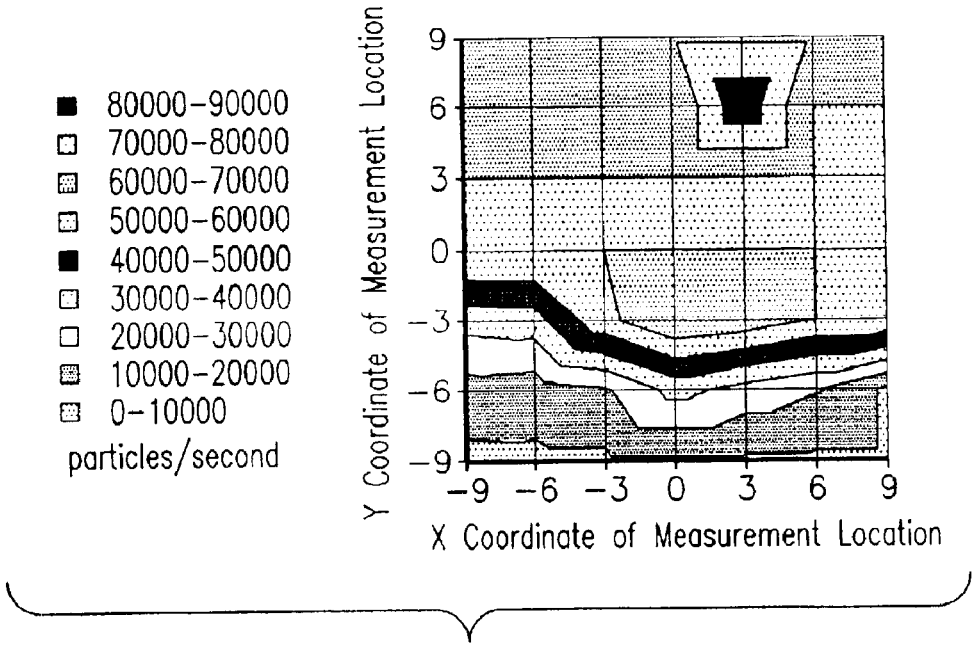

Notwithstanding the reproducibility of the maximum, mean and weighted averages for particle temperature and speed from start-to-start, the inventor of the present invention has determined that the expected resultant coating from start-to-start is not consistently reproduced with the same specified quality and structure. FIGS. 3, 4 and 5 illustrate the respective actual measurements of iso-speed, iso-thermal and iso-particle flow rate contours measured and plotted by analyzer 30, such as the DPV 2000 set at a 49_3measurement grid, during a production-coating run in an actual manufacturing environment. It will be recognized by those skilled in the art that each respective region illustrated in FIGS. 3, 4 and 5 represents actual data measured at each lattice point and an interpolation of that data between respective lattice points that may be plotted by algorithms programmed into the DPV 2000. In this respect, the contour maps provide a statistical estimate of the temperature, speed and flow rate for all particles within a cross section of a spray jet such as spray jet 24. As will be recognized by those skilled in the art, the mapped contours of FIGS. 3, 4 and 5 are not concentric with respect to the spray jet center (0,0). Further, unlike the optimum situation represented by concentric circles 10 of FIG. 1, the highest value regions of temperature, speed and particle flow rate within the spray jet are not coincident with the origin or spray jet center, or at any one lattice point within the mapped grid. Similar contour maps, not shown, demonstrate that the regions of highest temperature, speed and particle flow rate within the spray jet, vary individually as well as collectively for consecutive starts of a spray gun system using the same spray gun input and feedstock injection parameters from one spray run to another.

The inventor of the present invention has determined that if the highest particle flow rate region and the regions of highest particle temperature and highest particle speed are not coincident across a spray jet, such as spray beam or jet 24, then an unacceptable quantity of the particles from the highest flow rate region impinging a substrate may not be sufficiently melted. Such insufficiently melted or hot particles may be embedded as unmelted particles in the deposits of fully and/or partially molten particles. This may result in the entrapment of large size and insufficiently melted particles in the substrate coating. Such unmelted particles may also become dislodged during deposition because of poor adhesion thereby creating various size pores in the coating. Both of these exemplary consequences may be considered unacceptable and cause a rejection of the associated coating.

One aspect of the present invention allows for controlling a spray process so that the regions within a spray jet having the highest particle temperature, the highest particle velocity and the highest particle flow rate intersect or are substantially coincident within the spray jet proximate a surface of a substrate to be coated. This. creates a common region of particles within the spray jet that may produce a coating having specified quality and structure and allows for reproducing that coating on subsequent coating runs. It has been determined that maximizing the area of this common region creates a spatial coating of high quality and structure and allows for consistently reproducing that coating on subsequent coating runs. The common region may be formed as various shapes or sizes within the spray jet as a function of the operating parameters of the spray process and the desired coating quality and structure, for example.

The inventor of the present invention has determined that calculating the centroid for at least one measured in-flight particle property allows for off-line and/or on-line control of a spray process to produce a spray jet within which the regions of highest particle temperature and speed converge or are coincident with the region having the highest particle flow rate. Calculating and plotting the centroids provides a means for mathematically expressing or determining whether these regions converge into a common region within a spray jet, or are coincident or substantially coincident on or proximate a substrate's surface. It will be recognized by those skilled in the art that other mathematical, statistical and/or analytical methods, for example, may be used to make this determination. One aspect of the present invention allows for calculating the centroids for the temperature, speed and flow rate of in-flight particles and using the calculated centroids as a parameter for controlling the spray process. For example, the centroid of particle speed on a measurement plane, such as grid 33, is obtained by taking the moment of the selected in-flight particle property about the X and Y-axes.

$$\bar{x}_s = \frac{\sum_i x_i S_i}{\sum_i S_i} \quad \bar{y}_s = \frac{\sum_i y_i S_i}{\sum_i S_i}$$

where $x_i$ and $y_i$ are measurement coordinates in grid 33, $S_i$ is the measured in-flight particle speed (velocity) at that coordinate and i takes a value between −9 to 9. For temperature and particle flow rate the centroids are similarly defined as:

$$\bar{x}_t = \frac{\sum_i x_i T_i}{\sum_i T_i} \quad \bar{y}_t = \frac{\sum_i y_i T_i}{\sum_i T_i} \quad \text{and} \quad \bar{x}_f = \frac{\sum_i x_i F_i}{\sum_i F_i} \quad \bar{y}_f = \frac{\sum_i y_i F_i}{\sum_i F_i}$$

Figure 6:
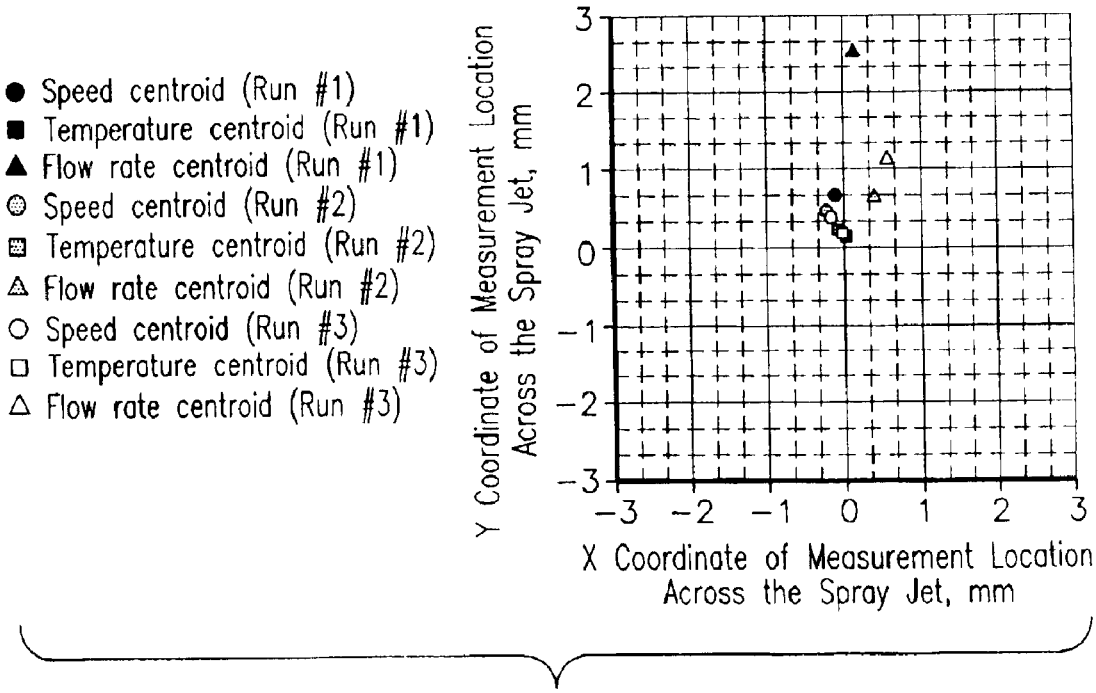
FIG. 6 illustrates the plotting of exemplary centroids calculated in accordance with aspects of the present invention.

FIG. 6 illustrates the plotting of centroids using the above centroid definitions for the three discrete runs listed in Table 1. FIG. 6 illustrates that the plotted positions of the temperature centroid from run to run remains virtually unchanged as indicated by the square symbol. Further, the change in the coordinates of the velocity centroid from run to run is very modest as indicated by the circle symbol. However, the coordinates of the particle flow rate centroid change significantly from run to run as indicated by the triangle symbol. These plots also demonstrate whether the regions within a spray jet having the highest particle temperature, speed and flow rate are coincident. Table 2 expresses numerically the data used for plotting the centroids in FIG. 6.

TABLE 2

| | | Coordinates of centroids, mm APS Run | | | | | |
|---|---|---|---|---|---|---|---|
| Run | Run | Speed, m/sec. | | Temperature, C. | | Flow Rate, particles/sec | |
| # | ID | x-bar | y-bar | x-bar | y-bar | x-bar | y-bar |
| 1 | 01:1/18/01 | −0.104 | 0.646 | 0.012 | 0.155 | 0.148 | 2.516 |
| 2 | 01:2/27/01 | −0.207 | 0.438 | −0.054 | 0.202 | 0.372 | 0.617 |
| 3 | 07:3/22/01 | −0.156 | 0.385 | −0.016 | 0.176 | 0.577 | 1.086 |

One aspect of the present invention allows for using the calculated centroid of at least one in-flight particle property as a control parameter for a spray process. One exemplary embodiment allows for a spray process to be controlled by adjusting at least one operating parameter of the spray process to reduce the area of a triangle formed by the plotted temperature, speed and flow rate centroids to as small of an area as possible. Ideally this area would be zero. Another exemplary embodiment allows for adjusting at least one of the operating parameters to reduce the distance between any two points of the temperature, speed and flow rate centroids to as small a distance as possible. These two exemplary embodiments allow for bringing the regions within a spray jet having the highest particle temperature, speed and flow rate closer together or causing them to converge or be coincident proximate the surface of a substrate to be coated. In one exemplary embodiment this may be accomplished by effecting a change in the anticipated trajectory of at least one ensemble of particles entering the spray jet by adjusting at least one operating parameter of the spray process. The formula for evaluating the area of a triangle may be:

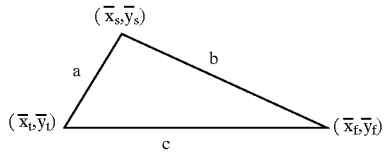

Area $=\sqrt{s(s-a)(s-b)(s-c)}$ where $$s = \frac{a+b+c}{2}:$$

a, b and c are side lengths.

$$a = \sqrt{(\bar{x}_s - \bar{x}_t)^2 + (\bar{y}_s - \bar{y}_t)^2}$$

$$b = \sqrt{(\bar{x}_t - \bar{y}_f)^2 + (\bar{y}_t - \bar{y}_f)^2}$$

$$c = \sqrt{(\bar{x}_f - \bar{x}_s)^2 + (\bar{y}_f - \bar{y}_s)^2}$$

One aspect allows for setting a maximum limit or boundary for the area of the triangle formed by the temperature, speed and flow rate centroids. For example, in the case of an APS process, the area may be set at approximately 0.1 square mm and the length of each side a, b and c may be less than or equal to approximately 0.5 mm. This is because the practical aspects and limitations of a typical spray gun system 12 and a manufacturing setting may not allow for these centroids to be completely coincident when plotted. Consequently, one aspect of the present invention allows for the area of the triangle and length of each leg to define acceptable limits on divergence of the centroids. These limits may be selected, relaxed and/or tightened depending on acceptable deviations on a specified coating's quality and structure, for example.

An alternate embodiment of the present invention allows for using the proximity of the three centroids to the spray beam center (origin of coordinates) as a condition for determining an acceptable coincidence of particle temperature, speed and flow rate within a spray jet. For example, this condition may be set in the form of a circle with center (0,0) and radius 1 mm. In this respect, one or more operating parameters associated with a spray process may be adjusted in response to the centroid calculations to bring the centroids within this circle. Another embodiment allows for defining an upper limit for proximity to be the distance between the origin (center of the spray beam) and the centroid of the three centroids. It will be recognized by those skilled in the art that other conditions may be used for defining an acceptable coincidence of particle temperature, velocity and flow rate within a spray jet.

One aspect of the present invention allows for controlling a spray process by adjusting operating parameters that control powder injection, for example, into the combustion or plasma jets. These operating parameters may include, among others that will be recognized by those skilled in the art, the carrier gas velocity, the feed rate of feedstock, particle size, the port diameter, the angular location of the feedstock port with respect to the spray jet, the angle of feedstock injection in relation to the Z axis, axial injection, powder injection downstream or upstream, multiple injection sites, annular injection, concentric injection or other operating parameters associated with the design of feedstock introduction. Additionally, the heat source settings may determine the maximum, mean and distribution of particle temperature. The flow rates of combustion or plasma gases and the geometry of a spray torch exit nozzle may determine the maximum, mean and distribution of particle velocity. The maximum and minimum size and the size distribution of particles depend on the form of feedstock.

One aspect of the present invention allows for evaluating such operating parameters to define the value of limits within which they may be adjusted, prioritize their associated degrees of freedom in terms of their respective response times to being adjusted and resulting stability. This may be done by a statistical design of experiments, for example. Another aspect allows for determining a minimum and/or maximum step change value for each operating parameter and the direction of the change required to bring and/or maintain the centroids within the specified limits. As will be recognized by those skilled in the art, evaluating these operating parameters and determining their respective influence on bringing and/or maintaining the centroids within the specified limits may vary as a function of the geometry and design of individual spray guns as well as other operation specific parameters associated with a spray process. Further, it will be recognized that the response from each of the input instruments based on an adjustment to a respective operating parameter should be fast, non-oscillatory, un-damped or not sluggish, and not result in any significant overshoots.

One aspect of the present invention allows for off-line control of one or more operating parameters to bring and/or maintain the particle temperature, speed and flow rate centroids within the specified limits to achieve a coating on a substrate within acceptable specified ranges of quality and structure. In this respect, a spray system, such as hot spray system 12, may be started in preparation to perform a production-coating run. The hot spray system 12 may then generate a spray jet 24. In-flight particle analyzer 30 may measure and store data indicative of particle temperature, speed and flow rate within spray jet 24. The particle temperature, speed and flow rate centroids may then be calculated. A processing module, such as processor 42, may be configured to determine whether the regions having the highest particle temperature, speed and flow rate within the spray jet 24 are within acceptable limits of coincidence such as by calculating their respective centroids. Processor 42 may be configured to evaluate all operating parameters associated with the hot spray system 12 and prompt an operator with a dropdown menu of options for adjusting one or more operating parameter in response to the calculated centroids. The menu of options may include the step change and the direction of change for the operating parameters having the highest probability of reducing the area of a triangle defined by the plotted centroids, for example. One or more iterations may be required for the operator to set the operating parameters prior to initiating the coating production run. In this respect, the operator may establish a set of baseline operating parameters associated with the hot spray process used for that coating production run.

Another aspect of the present invention allows for on-line monitoring and control of the spray process to determine whether the regions of highest mean temperature and speed, and highest flow rate with a spray jet are within acceptable limits of coincidence. For example, the particle temperature, speed and flow rate centroids may be periodically calculated and maintained within specified limits for a coating production run in progress. In this respect, a processing module, such as processor 42, may be configured to periodically or continuously calculate the centroids in response to in-flight particle property data measured by an analyzer 30. One embodiment allows for the analyzer 30 to be mounted on a spray gun 20 so that in-flight particle properties may be periodically or continuously measured during the coating run. Processor 42 may be configured to determine whether one or more of the operating parameters needs to be adjusted to bring and/or maintain the centroids within a baseline or preset limits. The processing module 42 may be configured to transmit signals to the spray gun 20 over a data link 43 to automatically adjust one or more of the operating parameters. For example, signals may be transmitted to processing modules of the hot spray system 12 configured to control the injection parameters of feedstock introduction and/or input parameters on the spray gun 20. The operating parameters may be adjusted and the processing module 42 may determine the need for any further adjustments during the run.

The processing module 42 may be configured to generate a warning signal that an operator may visually and/or audibly detect if the preset limits for coincidence of the highest particle temperature, speed and flow rate regions within the spray jet are not obtained within a predetermined period of time and/or a predetermined number of operating parameter adjustment iterations, for example. Alternate embodiments allow for the warning signal to be generated based on other criteria such as a determination that the particle flow rate is not within acceptable bounds, for example. One aspect allows for the processing module 42 to automatically shut down the coating production run within a predetermined period of time after generating the warning signal or the operator may manually override the automatic shutdown.

It will be recognized by those skilled in the art that aspects of the present invention described herein are applicable to all hot spray systems such as air plasma spray, all types of thermal spray, high velocity oxy-fuel spray, shrouded plasma spray and low-pressure plasma spray, for example. Aspects may also be used with other hot and cold spray systems that will be recognized by those skilled in the art.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. A method for controlling a spray process, the method comprising:

measuring a particle property associated with a spray jet of particles;

calculating a centroid for the measured particle property;

using the calculated centroid as a control parameter for controlling the spray process;

measuring temperature, speed and flow rate of at least one ensemble of particles associated with the spray jet of particles;

calculating temperature, speed and flow rate centroids for the measured temperature, speed and flow rate of the at least one ensemble of particles;

plotting the calculated centroids to define a triangle; and adjusting at least one operating parameter associated with the spray process to reduce an area of the triangle.

2. A method for controlling a spray process, the method comprising:

measuring a particle property associated with a spray jet of particles;

calculating a centroid for the measured particle property;

using the calculated centroid as a control parameter for controlling the spray process;

measuring temperature, speed and flow rate of at least one ensemble of particles associated with the spray jet of particles;

calculating temperature, speed and flow rate centroids for the measured temperature, speed and flow rate of the at least one ensemble of particles; and adjusting at least one operating parameter associated with the spray process to change a trajectory of at least one ensemble of particles associated with the spray jet of particles; and adjusting the at least one operating parameter so that an ensemble of particles having the highest measured temperature and an ensemble of particles having the highest measured velocity and an ensemble of particles having the highest measured flow rate are moved more closely together within the spray jet.

3. A method for controlling a spray process, the method comprising:

measuring a particle property associated with a spray jet of particles;

calculating a centroid for the measured particle property;

using the calculated centroid as a control parameter for controlling the spray process; and adjusting at least one operating parameter associated with the spray process in response to the calculated centroid so that an ensemble of particles having the highest measured temperature and an ensemble of particles having the highest measured velocity and an ensemble of particles having the highest measured flow rate form a common region within the spray jet proximate a surface of a substrate.

4. A method for controlling a spray process, the method comprising:

measuring a particle property associated with a spray jet of particles;

calculating a centroid for the measured particle property;

using the calculated centroid as a control parameter for controlling the spray process;

determining whether an ensemble of particles in the spray jet having the highest temperature and an ensemble of particles in the spray jet having the highest speed and an ensemble of particles in the spray jet having the highest flow rate are coincident within the spray jet; and using the calculated centroid to change a trajectory of at least a portion of the particles of the spray jet if the respective ensembles of particles are not coincident within the spray jet.

5. A method for controlling a spray process, the method comprising:

measuring a plurality of particle properties associated with a spray jet of particles;

calculating a centroid for each measured property;

using the calculated centroids as a control parameter for controlling the spray process; and adjusting at least one operating parameter associated with the spray process in response to the calculated centroids so that the spray process produces a spray jet within which an ensemble of particles having the highest temperature and an ensemble of particles having the highest velocity and an ensemble of particles having the highest flow rate define respective trajectories that form a common region within the spray jet proximate a surface of a substrate.

6. A method for controlling a spray process, the method comprising:

measuring a plurality of particle properties associated with a spray jet of particles;

calculating a centroid for each measured property;

using the calculated centroids as a control parameter for controlling the spray process;

plotting the calculated centroids to define a triangle; and adjusting at least one operating parameter associated with the spray process to reduce an area of the triangle.

7. The method of claim 6 wherein the step of adjusting changes a trajectory of at least a portion of particles associated with the spray jet of particles.

8. A method for controlling a spray process of a hot spray system that uses a continuous heat source for partially and/or fully melting particles, a feedstock of particles to be propelled within a spray jet, a continuous delivery system for delivering particles from the feedstock into the heat source to form a spray jet of particles, the method comprising:

determining whether an ensemble of particles having the highest temperature and an ensemble of particles having the highest velocity and an ensemble of particles having the highest flow rate form a common region within the spray jet of particles; and adjusting at least one operating parameter associated with the hot spray system in the event the respective ensembles of particles do not form the common region.

9. The method of claim 8 wherein the step of adjusting changes a trajectory of a portion of the particles associated with the spray jet of particles.

10. The method of claim 8, the step of determining comprising:

calculating a temperature centroid, a speed centroid and a flow rate centroid for at least one portion of the particles within the spray jet of particles;

plotting the calculated centroids to define a triangle; and determining whether an area of the triangle is within an acceptable range indicative of the respective ensembles of particles forming the common region.

11. The method of claim 8, the step of determining comprising:

calculating a temperature centroid, a speed centroid and a flow rate centroid for at least one portion of the particles within the spray jet of particles; and determining whether the calculated centroids satisfy a predetermined condition.

12. The method of claim 8 further comprising:

defining a limit for adjusting the at least one operating parameter associated with the hot spray system.

13. The method of claim 12 further comprising:

defining a step change value for adjusting the at least one operating parameter associated with the hot spray system.

* * * * *